United States Patent [19]

Ellgass

[11] Patent Number: 4,858,382

[45] Date of Patent: Aug. 22, 1989

[54] ARTICULATABLE BARRIER FOR RESTRICTING ACCESS TO PARKING SPACES, ROADWAYS, PASSAGEWAYS AND THE LIKE

[75] Inventor: Gerard Ellgass, Bussigny-Lausanne, Switzerland

[73] Assignee: Samuel Blair, Territet, Switzerland; a part interest

[21] Appl. No.: 272,314

[22] Filed: Nov. 17, 1988

[51] Int. Cl.[4] ..... E05B 65/00; E01F 13/00

[52] U.S. Cl. ..... 49/35; 49/49; 49/131

[58] Field of Search ..... 49/35, 131, 49

[56] References Cited

U.S. PATENT DOCUMENTS

| | | | |
|---|---|---|---|
| 3,061,960 | 11/1962 | Dull | 49/35 |
| 3,417,508 | 12/1968 | Sprung | 49/35 |
| 3,688,439 | 9/1972 | Doxsee | 49/35 |
| 3,913,264 | 10/1975 | Kohen | 49/49 |
| 3,925,929 | 12/1975 | Montgomery | 49/35 |
| 3,956,853 | 5/1976 | Montgomery | 49/35 |
| 4,050,190 | 9/1977 | Mazzone | 49/35 |
| 4,137,662 | 2/1979 | Baumer | 40/612 |
| 4,190,379 | 2/1980 | Toro Sosa et al. | 404/6 |
| 4,531,472 | 7/1985 | Marrero et al. | 116/28 R |
| 4,713,910 | 12/1987 | Quante | 49/49 |

FOREIGN PATENT DOCUMENTS

| | | | |
|---|---|---|---|
| 967322 | 8/1964 | United Kingdom | 49/131 |

*Primary Examiner*—Philip C. Kannan

*Attorney, Agent, or Firm*—Leonard Bloom

[57] ABSTRACT

An articulatable barrier for selectively restricting access to a parking space, roadway, passageway or the like. The barrier includes a base and a barrier frame that is pivotally journaled through the base at a pivot axis for pivotal movement of the frame between a first obstructing position and a second nonobstructing position. The base has an aperture formed therein above the pivot axis. The frame carries a center bolt for movement of the bolt between a first lowered position and a second raised position. In the first lowered position, the bolt is received in the base through the aperture, for supporting the frame and for maintaining the frame in the obstructing position. In the second raised position, the bolt is spaced from the aperture and the base for permitting the pivotal movement of the frame. Means is provided for moving the bolt in a second raising direction, wherein the bolt is withdrawn from the base and the aperture being moved into the second raised position. This means also permits the bolt to move in a first lowering position, wherein, when the frame is in the obstructing position, the bolt is received in the base through the aperture.

20 Claims, 8 Drawing Sheets

ARTICULATABLE BARRIER FOR RESTRICTING ACCESS TO PARKING SPACES, ROADWAYS, PASSAGEWAYS AND THE LIKE

FIELD OF THE INVENTION

The present invention relates to articulatable barriers for selectively restricting access to parking spaces, roadways, passageways and the like.

BACKGROUND OF THE INVENTION

The use of barriers for restricting access to parking spaces, roadways, passageways and the like is well known. Devices proposed include barriers that are pivotally mounted to a base, so that the barrier may be pivoted between an operative obstructing position and a nonoperative nonobstructing position. It has also been proposed to provide a locking mechanism to maintain the barrier in a chosen position. The following are representative of these prior efforts:

| Pat. No. | Inventor | Year of Issue |
|---|---|---|
| 3,417,508 | Sprung | 1968 |
| 3,688,439 | Doxsee | 1972 |
| 3,913,264 | Kohen | 1975 |
| 3,925,929 | Montgomery | 1975 |
| 3,956,853 | Montgomery | 1976 |
| 4,050,190 | Mazzone | 1977 |
| 4,137,662 | Baumer | 1979 |
| 4,190,379 | Toro Sosa et al. | 1980 |
| 4,531,472 | Marrero et al. | 1985 |
| 4,713,910 | Quante | 1987 |

While providing positive protection against the unauthorized use of a parking space, roadway, passageway or the like, these barriers are nonetheless subject to extensive damage and distortion which can result from the impact of, for example, an automobile that either accidentally of purposefully comes into contact therewith. Such damage is especially acute where the barrier is pivotally connected to the base by a pin or shaft that is relatively weak as compared to the remainder of the barrier. This pin or shaft therefore constitutes the weak point in the barrier, and it is also the portion thereof that is the most subject to deformation of destruction under stress, especially that resulting from the impact of an automobile. Attempts to solve this problem have resulted in various locking and support arrangements being proposed that are quite complicated and expensive.

In order to gain widespread acceptance, the barrier must be practical, easy to operate and economical to manufacture and install. Unfortunately, proposals to provide a barrier that is relatively resistant to impact, or which provide a locking mechanism, have not, in one way or another, fulfilled at least one of the criteria. This is thought to be the reason why these barrier devices are not in widespread use.

Thus, it can be seen that there remains a need for an articulatable barrier for restricting access to a parking space, roadway, passageway or the like that is particularly heavy-duty and resistant to impact, wherein stress exerted upon the barrier will not be centered at the pivotal connection between the frame and the base, wherein the locking mechanism therefor is simple and is capable of operating the barrier and wherein the barrier is practical, easy to operate and economical to manufacture and install.

SUMMARY OF THE INVENTION

Accordingly, it is a primary object of the present invention to provide a heavy duty articulatable barrier for, alternatively, permitting and preventing access to a parking space, roadway, or passageway that is simple to use and to install, economical to manufacture and which is highly resistant to impact and damage.

It is another object of the present invention to provide such an articulatable barrier which is pivotal (articulatable) between obstructing and a nonobstructing positions and wherein when stress is exerted upon the barrier, it will not be centered or localized at the pivotal connection between the frame and the base of the barrier.

It is still another object of the present invention to provide a barrier in which the pivotal connection between the frame and the base is below that portion of the barrier which secures and supports the frame in position, so that stress upon the barrier will not be exerted directly upon the pivotal connection.

It is a further object of the present invention to provide a barrier of extreme simplicity of construction and use, which employs a minimum number of components, all of which are inexpensive.

It is a still further object of the present invention to provide such a barrier which can be easily articulated between raised and lowered positions, and which can be locked in a raised obstructing position to deny access to the parking space, roadway, passageway or the like to all persons, except those authorized users who may gain access thereto by means of a key.

It is a still yet further object of the present invention to provide a simple locking means for securely locking and maintaining a barrier in an operative obstructing position and for automatically permitting the barrier to be placed in its nonoperative nonobstructing position, merely by the unlocking thereof.

In accordance with the teachings of the present invention, an articulatable barrier is disclosed which selectively restricts access to a parking space, roadway, passageway or the like. This barrier includes a heavy-duty base. This base has an aperture formed therein. A heavy-duty pivotal barrier frame is journaled through the base below the aperture for pivotal movement of the barrier between a first obstructing position and a second nonobstructing position. In the obstructing position, ingress and egress to the parking space, roadway, passageway or the like is prevented. In the nonobstructing position, ingress and egress to the parking space, roadway, passageway or the like is permitted. A center bolt having a longitudinal axis is provided. This center bolt is carried by the frame for longitudinal movement of the bolt between a first lowered position and a second raised position. In the first lowered position, the center bolt is received through the aperture and into the base for securing and supporting the barrier frame in the obstructing position. In the second raised position, the center bolt is spaced from the base for permitting the barrier frame to pivotally move between the obstructing and nonobstructing positions. A key lock means provides withdrawing the bolt from the base. In this manner, movement of the lock means in a first direction permits the bolt to move into the first lowered position when the frame is in the first obstructing position. In this position, the bolt supports and maintains the frame in the obstructing position. Also in this manner, movement of the lock means in a second direction moves the bolt into the second raised position. In this position, the frame is permitted to be selectively pivoted between the obstructing and nonobstructing positions.

In further accordance with the teachings of the present invention, an articulatable barrier is disclosed which selectively restricts access to a parking space, roadway, passageway or the like. This barrier includes a base. The base includes an upwardly-extending member. The upwardly-extending member has an aperture formed therein. A pivotal barrier frame is journaled through the upwardly-extending member for pivotal movement of the barrier between a first obstructing position and a second nonobstructing position. In the first obstructing position, ingress and egress to the parking space, roadway, passageway or the like is prevented. In the second nonobstructing position, ingress and egress to the parking space, roadway, passageway or the like is permitted. A center bolt is provided having a longitudinal axis. The center bolt is carried by the barrier frame with the longitudinal axis thereof intersecting the upwardly-extending member for longitudinal movement of the center bolt between a first lowered position and a second raised position. In the first lowered position, the center bolt is received through the aperture and in the upwardly-extending member for securing and supporting the barrier frame in the first obstructing position. In the second raised position, the center bolt is spaced from the upwardly-extending member for permitting the barrier frame to be pivotally moved between the first obstructing and second nonobstructing positions. Finally, there is provided means for longitudinally withdrawing the bolt from the aperture and the upwardly-extending member and into the second raised position. In this manner, the barrier frame can be pivoted between the first obstructing and second nonobstructing positions. This means also permits the bolt to longitudinally move into the first lowered position when the frame is in the first obstructing position. In this manner, the barrier frame is supported by the center bolt in the first obstructing position.

In further accordance with the teachings of the present invention, a barrier is disclosed which selectively restricts access to a parking space, roadway, passageway or the like. This barrier includes a base. The base includes an upwardly-extending member. The upwardly-extending member has an aperture formed therein. A pivotal barrier frame is journaled through the upwardly-extending member for pivotal movement of the barrier between a first obstructing and a second nonobstructing position. In the first obstructing position, ingress and egress to the parking space, roadway, passageway or the like is prevented. In the second nonobstructing position, ingress and egress to the parking space, roadway, passageway or the like is permitted. The barrier frame includes a housing portion. A center bolt is provided having a longitudinal axis. The center bolt is positioned at least partially in the housing portion with the longitudinal axis of the center bolt intersecting the upwardly-extending member for longitudinal movement of the center bolt in the housing portion between a first lowered position and a second raised position. In the first lowered position, the center bolt is received through the aperture and in the upwardly-extending member for securing and supporting the barrier frame in the first obstructing position. In the second raised position, the center bolt is spaced from the upwardly-extending member for permitting the barrier frame to be pivotally moved between the first obstructing and second nonobstructing positions. Finally, there is provided means for longitudinally withdrawing the bolt from the aperture and the upwardly-extending member and into the second raised position. In this manner, the barrier frame can be pivoted between the first obstructing and second nonobstructing positions. This means also permits the bolt to longitudinally move into the first lowered position when the frame is in the first obstructing position. In this manner, the barrier frame is supported by the center bolt in the first obstructing position.

Preferably, the means for longitudinally withdrawing the center bolt includes a key lock. This key lock is associated with the center bolt so that movement of the key lock in first and second opposite directions moves the center bolt in, respectively, the first lowering and second raising directions.

These and other aspects of the present invention will become apparent from a reading of the following specification taken in conjunction with the enclosed drawings.

BRIEF DESCRIPTION OF THE DRAWINGS

FIG. 5 is a perspective view of the articulatable barrier showing the key lock being moved in a second locking direction.

FIG. 6 is a perspective view of the articulatable barrier showing the frame being pivoted (articulated) from the first obstructing position towards the second nonobstructing position.

FIG. 7 is a perspective view of the articulatable barrier showing the frame in the second nonobstructing position.

FIG. 8 is a side view of the articulatable barrier showing the frame in the second nonobstructing position.

FIG. 9 is a side view of the articulatable barrier illustrating how a vehicle may gain ingress to and egress from a parking space, roadway, passageway or the like over the barrier when the frame is in the second nonobstructing position.

FIG. 10 is a side view of the articulatable barrier illustrating how a vehicle is prevented from ingress or egress from a parking space, roadway, passageway or the like when the frame is in the first, obstructing position.

FIG. 11 is a side view of the articulatable barrier in the first obstructing position and the second nonobstructing position illustrating the key lock being moved in a first unlocking direction and showing, the movement of the key lock and the center bolt.

DESCRIPTION OF PREFERRED EMBODIMENTS

Figure 1:
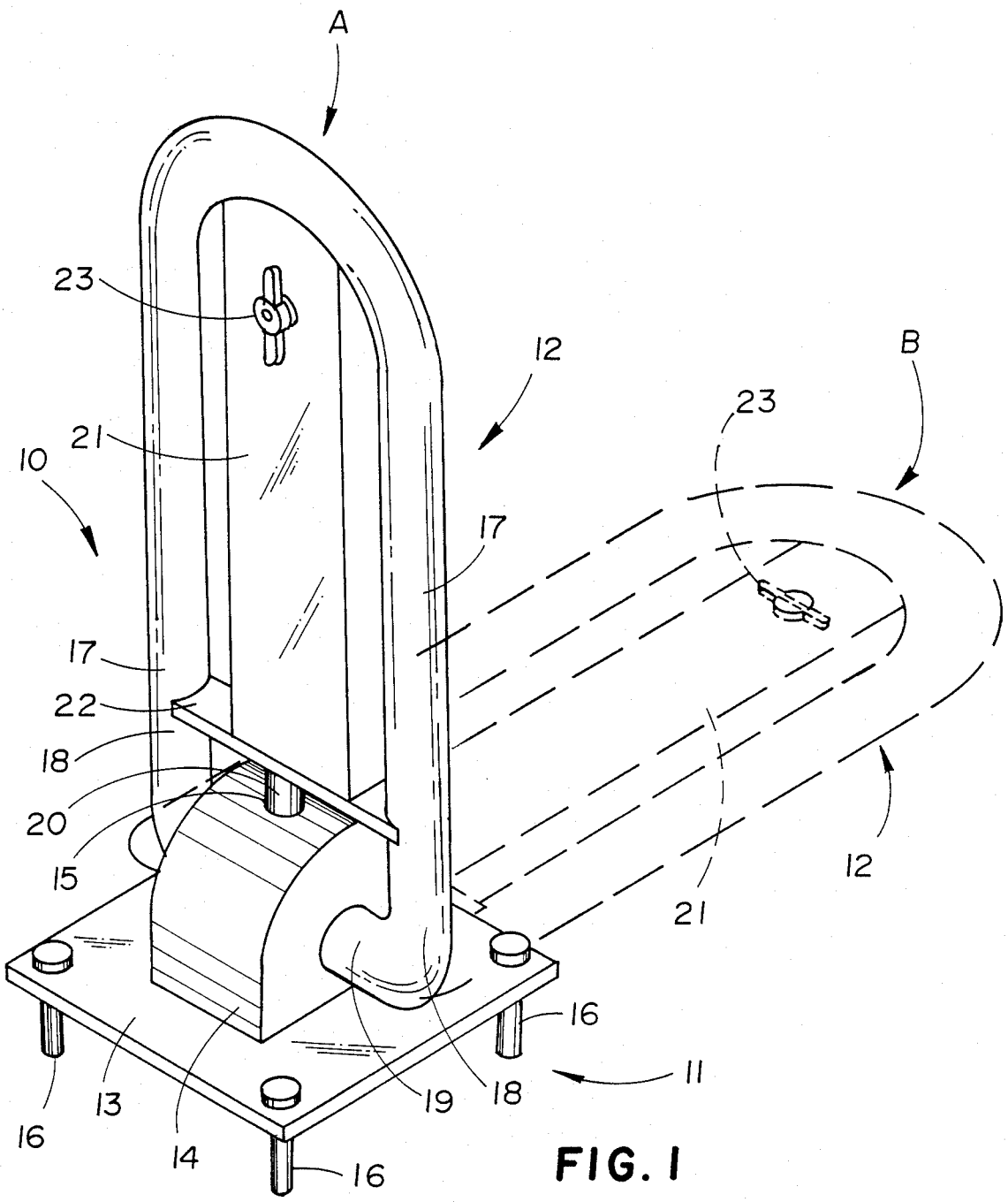
FIG. 1 is a perspective view of the articulatable barrier of the present invention illustrating, in phantom lines, the position of the frame in the first obstructing position and second nonobstructing position.
Figure 2:
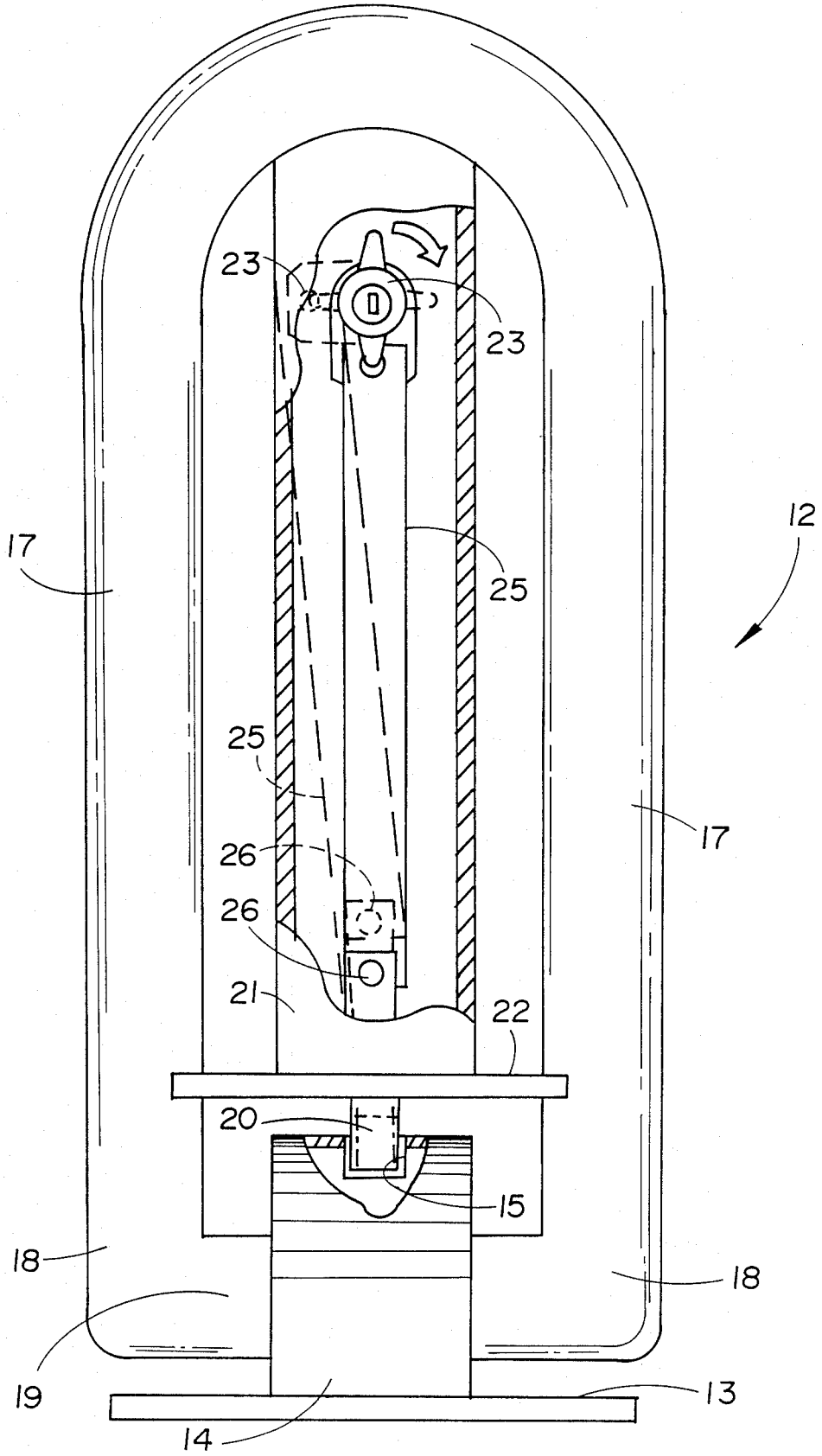
FIG. 2 is a front view of the articulatable barrier of FIG. 1 with the frame in the first obstructing position, and having parts of the housing portion broken away to reveal the positioning of the center bolt therein, and the position of the key lock.
Figure 3:
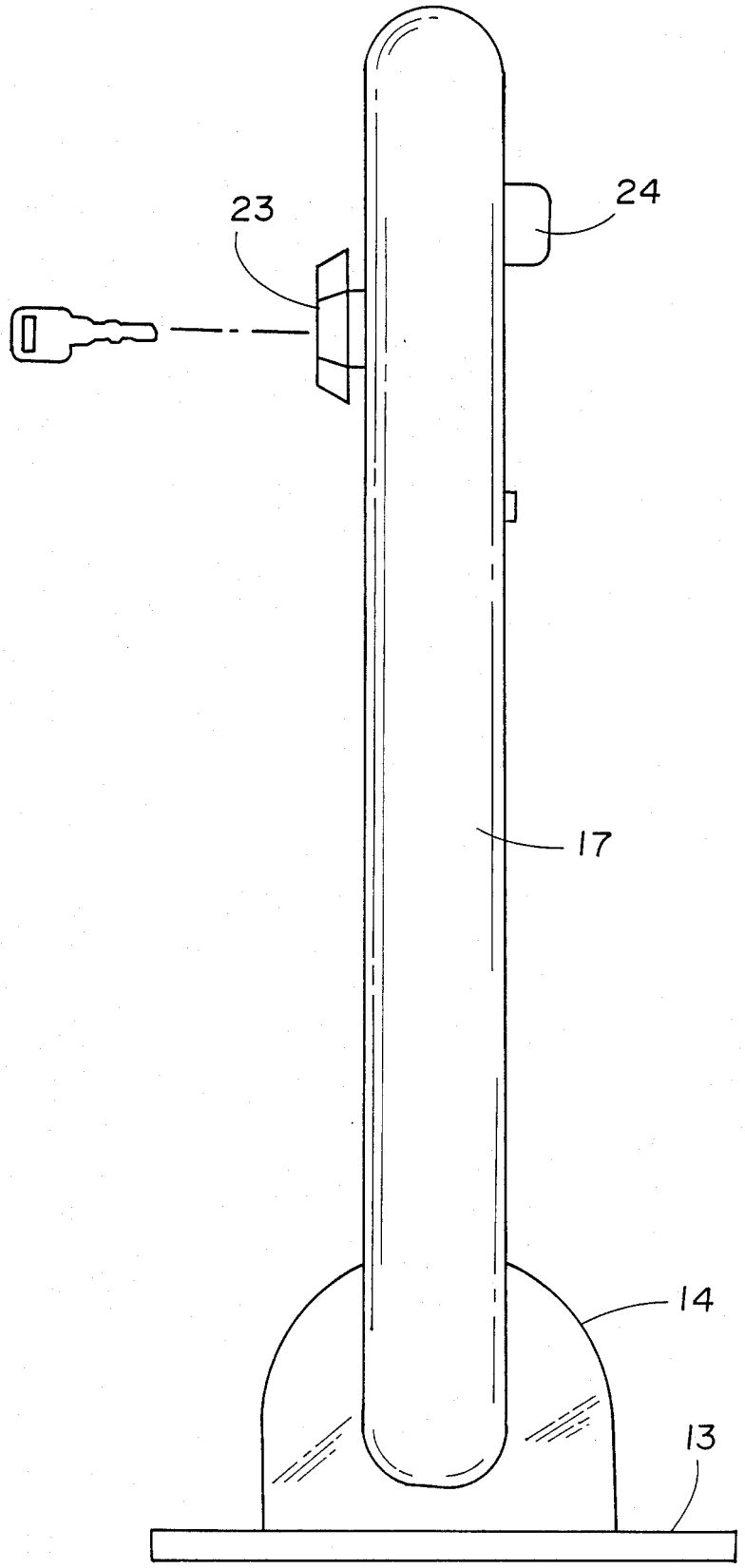
FIG. 3 is a side view of the articulatable barrier of FIG. 1 with the barrier in the first obstructing position.
Figure 4:
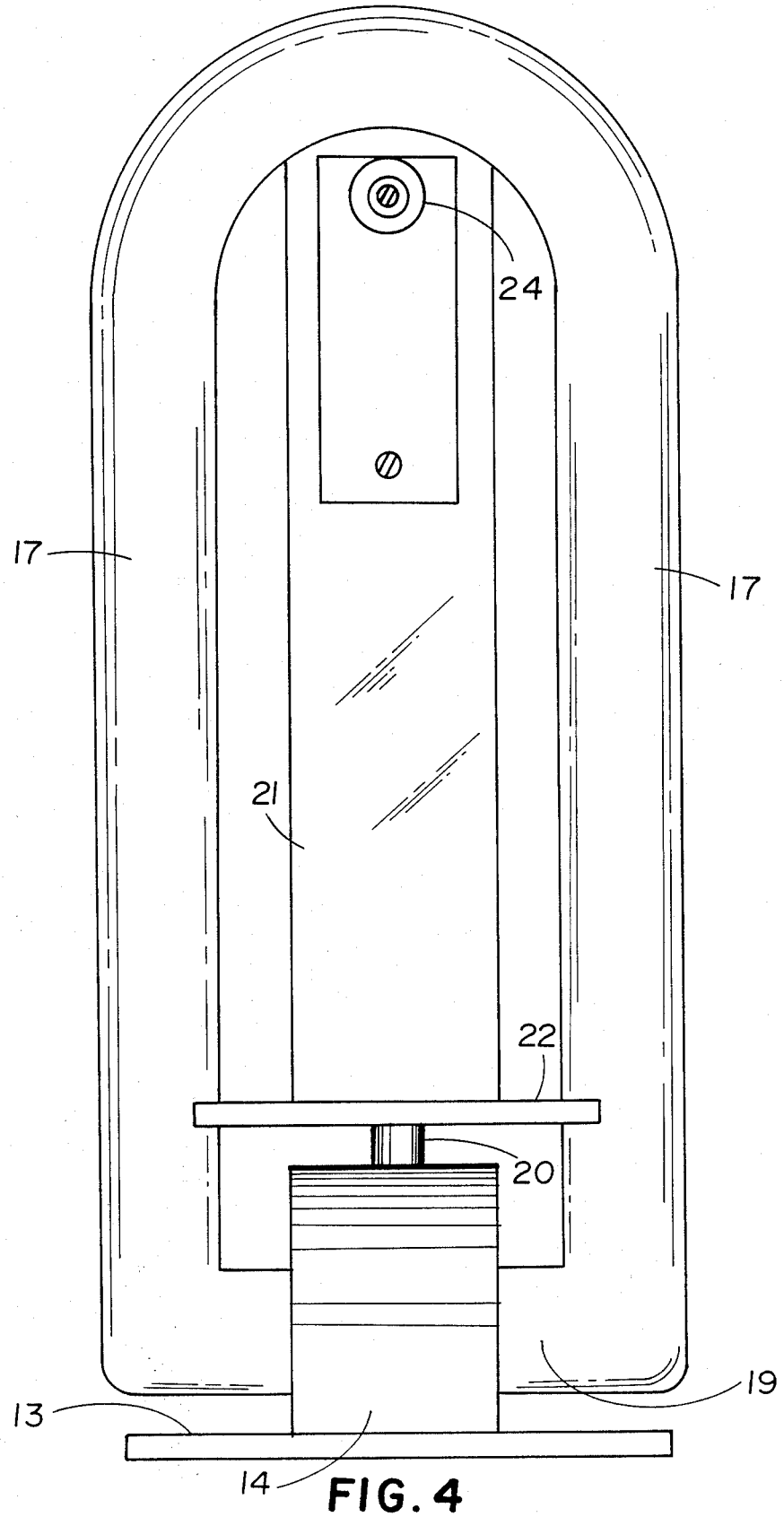
FIG. 4 is a rear view of the articulatable barrier of FIG. 1 with the frame in the first obstructing position.
Figure 5:
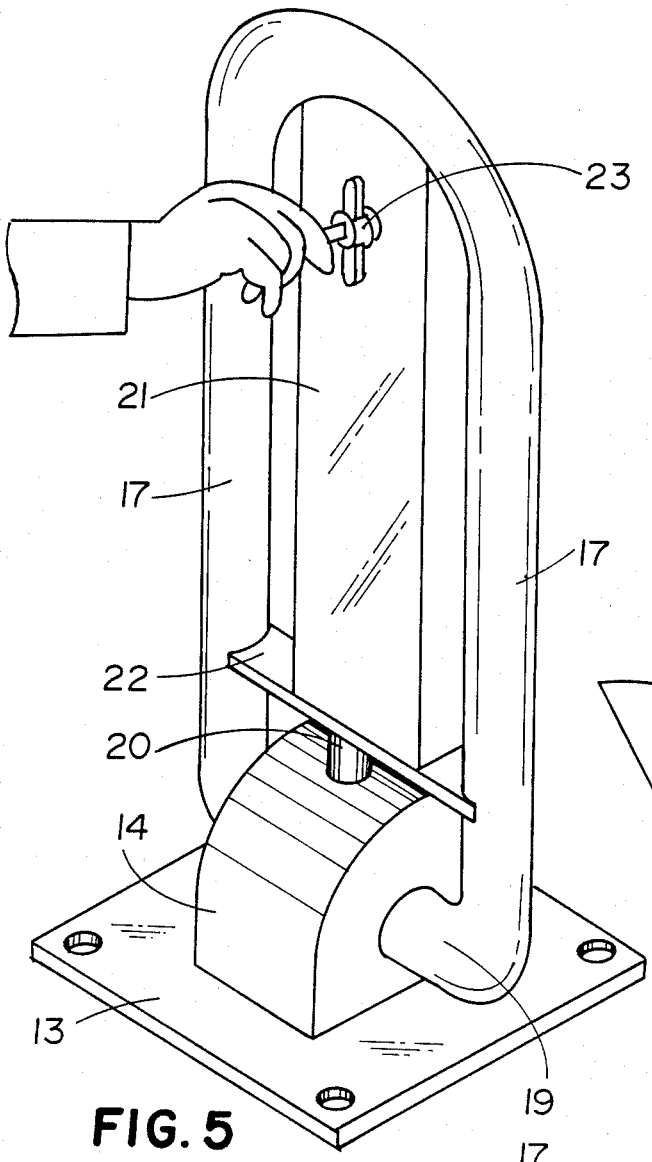
FIG. 5–11 progressly illustrate the use and operation of the barrier in FIG. 1.

The articulatable barrier 10 includes a heavy-duty base 11 and a heavy-duty barrier frame 12 that is pivotally joined thereto. Pivotal (articulating) movement of the frame 12 about the base 11 selectively permits and restricts access to a parking space, roadway, passageway, or the like, as desired or needed.

Referring in particular now to FIGS. 1–6 the base 11 includes a base plate 13 and a heavy-duty upwardly-extending member 14. The upwardly-extending member 14 includes an aperture 15 that is formed therein. The base plate 13 is secured to the ground or other support 1 by any suitable means, such as bolts 16. The upwardly-extending member 14 is, in turn, joined to or otherwise integral with the base plate 13.

Preferably, the upwardly-extending member 14 is substantially arcuate in shape. However, it is to be understood that the member 14 may be any suitable shape that provides sufficient clearance for the pivotal movement (articulation) of the frame 12 thereabout. It is further preferred that the member 14 and the frame 12 be of (equally) heavy-duty construction, so as to be especially resistant to deformation or damage the results from impact, such as from an automobile.

The pivotal barrier frame 12 is journaled through the member 14 along a horizonal pivot axis defined thereby below the aperture 15 for pivotal (articulating) movement of the frame 12 between a first obstructing positions A (FIG. 1) and a second nonobstructing position B (FIG. 1). In the first obstructing position, ingress and egress to the parking space, roadway, passageway or the like is prevented. In the second nonobstructing position, ingress and egress to the parking space, roadway, passageway or the like is permitted.

The pivotal (articulatable) barrier frame 12 includes a pair of side arms 17 that are substantially parallel to one another. Each of the side arms 17 includes a respective lower portion 18. A lower horizontal arm 19 is journaled through the member 14 along the horizontal pivot axis. Horizontal arm 19 is further positioned extending between and is integral with the respective lower portions 18.

It will be understood that, while described above as a single horizontal arm 19, if desired two separate horizontal arms 19 which are positioned on the common pivot axis may be provided. Each horizontal arm would have a first end which is integral with a respective lower position 18 and a second opposite end which is journaled in the upwardly-extending member 14 of the base 11. In this respect, these two horizontal arms would function to permit the articulatable, pivotal movement of the frame 12 in the same fashion as if only one arm 19 were provided.

The side arms 17 are further joined to one another at the top portions thereof, so as to form a substantially inverted "U" shape. Preferrably, these top portions are bent towards one another so that the side arms 17 are joined with an arched bend. However, it is to be understood that these top portions, may, if desired, be straight or angled, so that this junction would be straight or any other suitable angle.

A center bolt 20 is carried by the barrier frame 12 between and substantially parallel to the side arms 17. The center bolt 20 has a longitudinal axis that, as carried by the frame 12, intersects the member 14. The center bolt 20 is further carried by the frame for longitudinal movement of the bolt 20 between a first lowered position and a second raised position. In the first lowered position, the center bolt 20 is received through the aperture 15, and in the member 14, for securing and supporting the frame 12 in the first obstructing position. In the second raised position, the center bolt 20 is spaced from the member 14 for permitting the frame 12 to be pivotally moved (articulated about the pivot axis) between the first obstructing and second nonobstructing positions.

It is preferred that, in the first lowered position, the center bolt 20 be received through the aperture 15 and be positioned in the member 14 above the pivot axis and above the lower horizontal arm 19. The positioning of this lower arm 19 along the pivot axis below the aperture 15 results in pressure, such as that from an automobile, entered upon the frame 12 in the obstructing position being taken up by other portions of the frame, so that a substantial portion of the stress will not be entered upon the pivotal connection between the center bolt 20, the aperture 15 and the member 14. This provides the barrier 10 with an overall increased strength or ability to withstand greater amounts of pressure being entered thereon and lessens the risk of damage to the pivotal connection.

The barrier frame 12 further includes a substantially hollow housing portion 21. The center bolt 20 is positioned in the housing portion 21 for longitudinal movement between the first lowered and second raised positions. The barrier frame 12 further has a bumper 24 mounted at the top of one side of the frame 12 so that, when the barrier 10 is in the second nonobstructing position, the bumper 24 rests on the ground or other support 1.

Preferably, the housing portion 21 is integral with and supported by, on one end, the top portions of the side arms 17, and on a second, opposite side by a guide support 22. This guide support 22, like the lower horizontal arm 19, extends between and is integral with the side arms 17, being substantially parallel to the arm 19. The guide support 22 has an aperture formed therein that is—when the frame 12 is in the first obstructing position—substantially aligned with the aperture 15. The aperture formed in the support 22 receives the center bolt 20 therethrough and aids in guiding the longitudinal movement of the bolt 20. Support 22 also provides additional structural support, rigidity and integrity to the barrier 10.

Means is provided for longitudinally moving the bolt 20, so as to withdraw the bolt 20 from the member 14 and into the second, raised position. In this fashion, the frame 12 can be pivoted (articulated) between the first obstructing and second nonobstructing positions. This same means is also provided for permitting the bolt 20 to longitudinally move into the first lowered position, when the frame 12 is in the first obstructing position. In this fashion, the barrier frame 12 is supported by the center bolt 20 in the first obstructing position.

It is contemplated herein that the means for withdrawing the bolt 20 includes a key lock 23. This key lock 23 is a lock that is operated and activated by movement (usually rotational movement) of a key that mates and cooperates with the lock. This key lock 23 is carried by the housing portion 21. The key may be separable from, or integral with, the lock.

In a preferred embodiment, the key lock 23 is also associated with the center bolt 20 for locking the center bolt 20 in at least its first lowered position. In this fashion, free pivotal movement (articulation) of the frame is not permitted about the pivot axis. The key lock is connected to a lever 25 which extends through the housing portion 21 to a pivot pin 26 which engages the lever 25 and the center bolt 20.

In another preferred embodiment, the key lock 23 is associated with the center bolt 20, such that unlocking of the key lock 23 permits moving the center bolt 20 in the second raising direction, thereby withdrawing the bolt 20 from the aperture 15 and placing the bolt 20 into the second raised position. This permits the frame 12 to be pivotally moved (articulated) and, if desired, be placed in the second nonobstructing position.

With the frame 12 in the obstructing position (FIG. 5) ingress and egress to and from a parking space, roadway, passageway or the like is prevented. The center bolt 20 is in the first lowered position, wherein the bolt 20 is received through the aperture 15 and in the member. In this lowered position, the bolt 20 supports the frame 12 and maintains (or secures) the frame 12 in the obstructing position. It is contemplated that, in the obstructing position, the frame 12 will be substantially perpendicular to the base plate 13 and the ground (or the support) upon which it is positioned.

Figure 6:
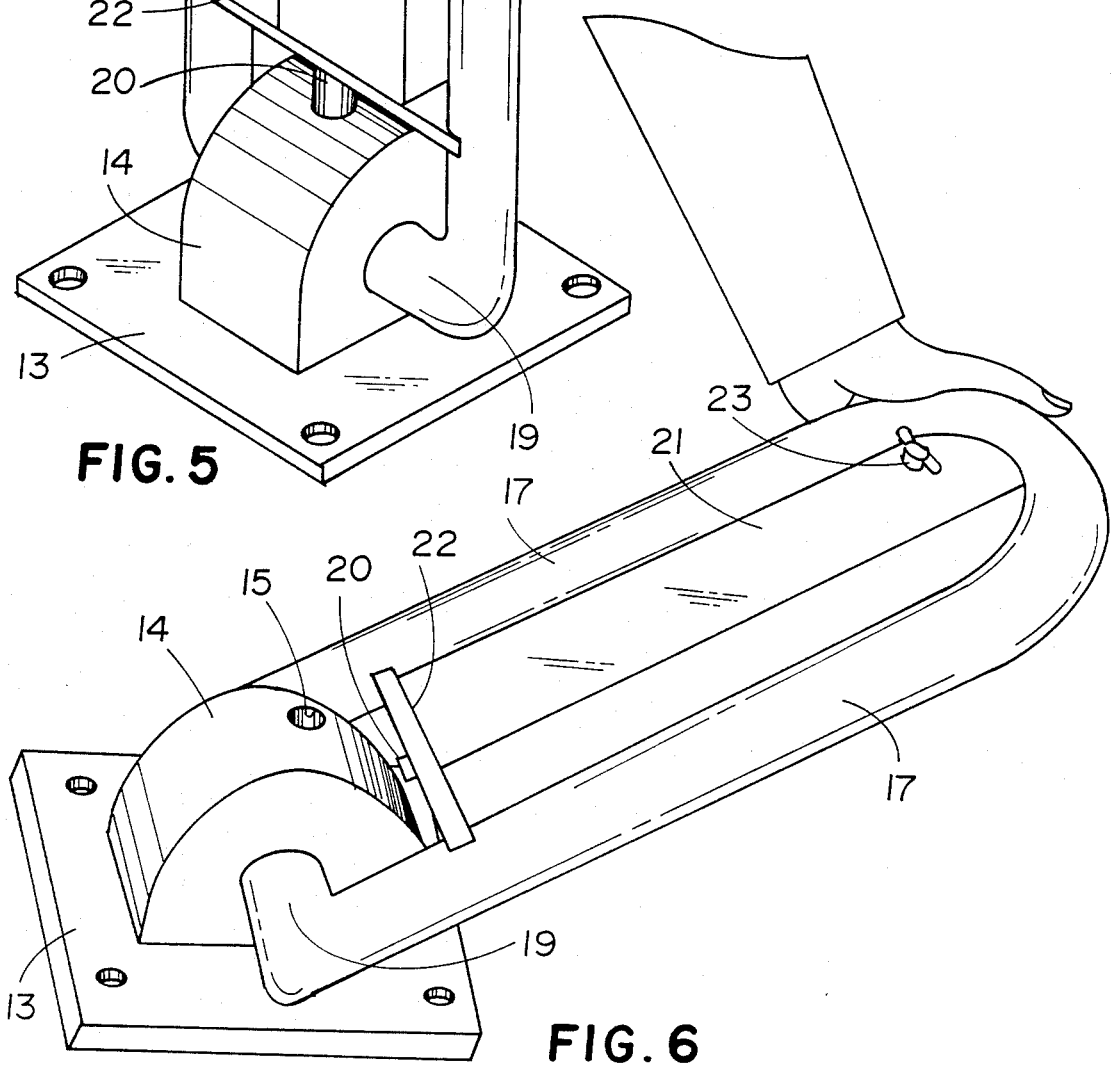

The key in the key lock 23 is then moved (or rotated) in a second opposite (unlocked) direction. This movement of the key lock 23 moves the center bolt 20 upwardly in the second raising direction, whereby the bolt 20 is withdrawn from the member 14 and the aperture 15, and moved into the second raised position, wherein the bolt 20 is spaced from the member 14. When in this second raised position, the bolt 20 will not interfere with, and permits, the pivotal movement (articulation) of the frame (FIG. 6).

Figure 7:
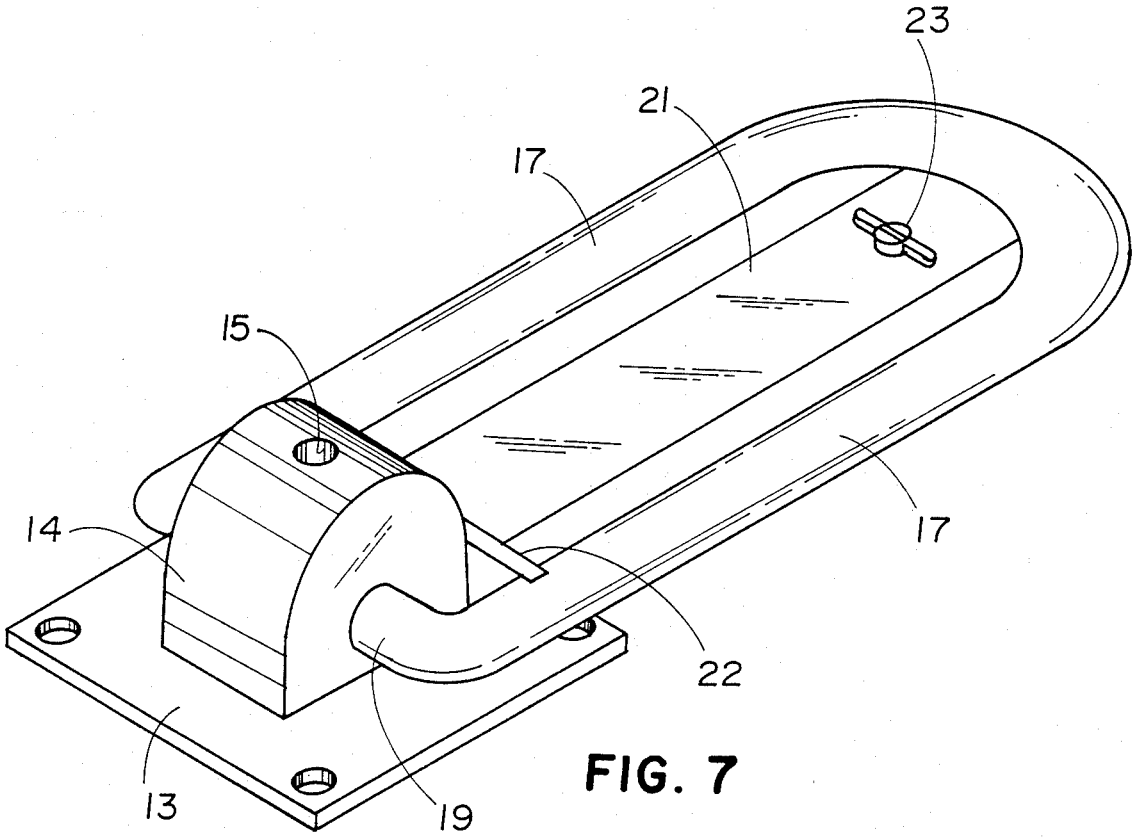
Figure 8:
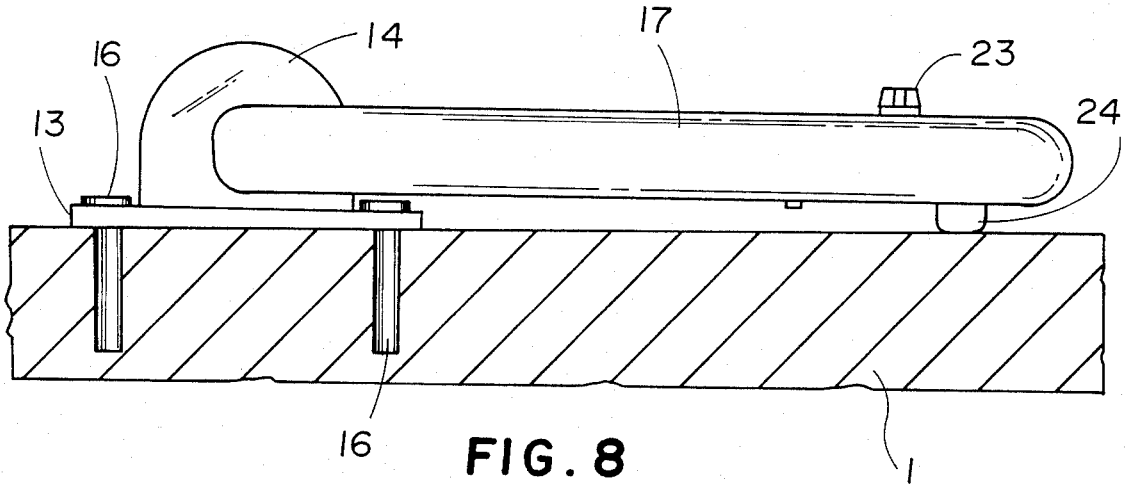
Figure 9:
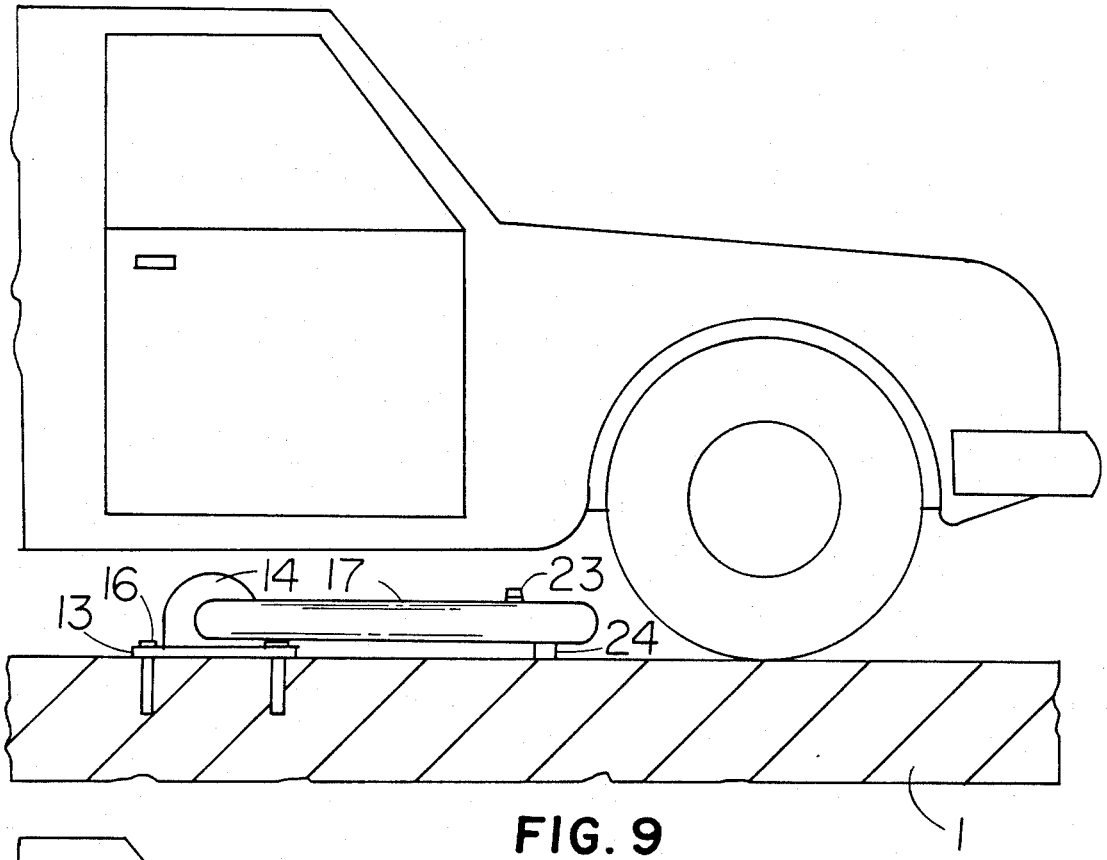
Figure 10:
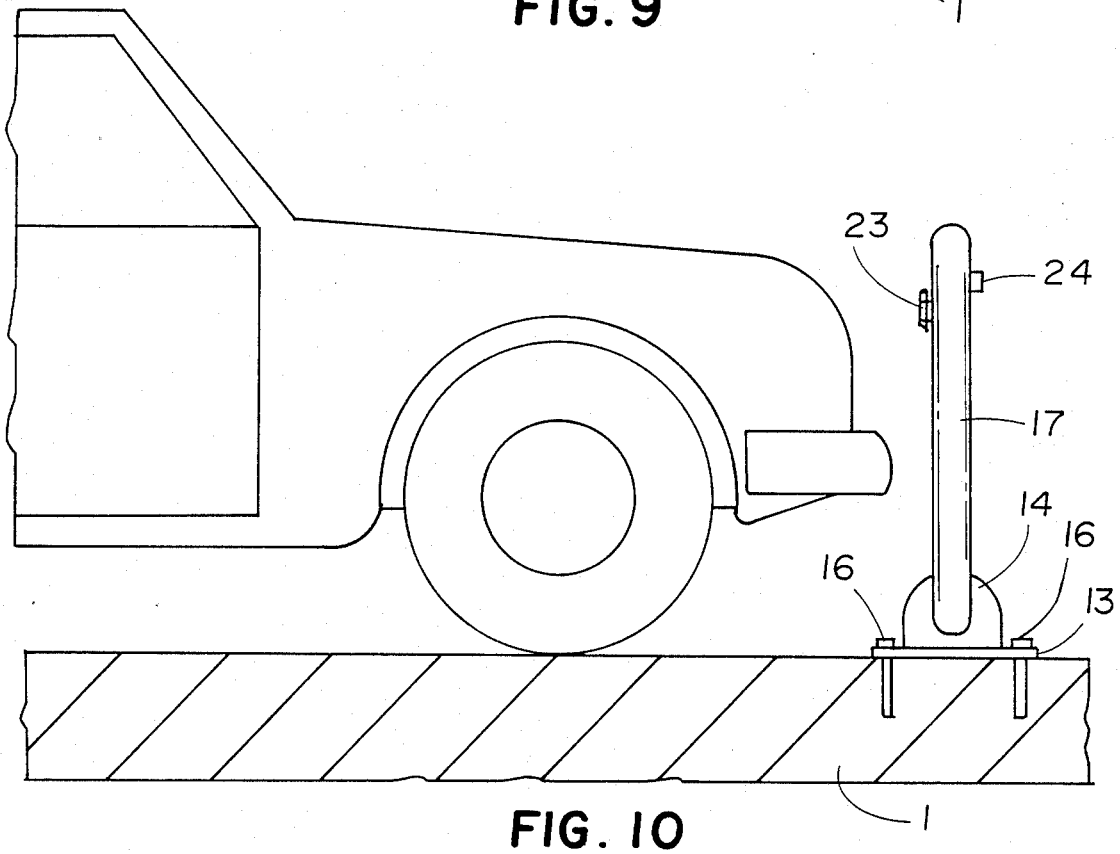

The frame 12 is then pivoted (FIGS. 7–8) into its second nonobstructing position, wherein ingress to and egress from the parking space, roadway, passageway or the like is permitted. In this nonobstructing position, it is contemplated that the frame 12 will be substantially parallel to the base plate 13 and the ground or the support upon which it is positioned. In this position, a vehicle such as an automobile, may freely pass thereover (FIG. 9). In the obstructing position, the vehicle is prevented from passage (FIG. 10).

Figure 11:
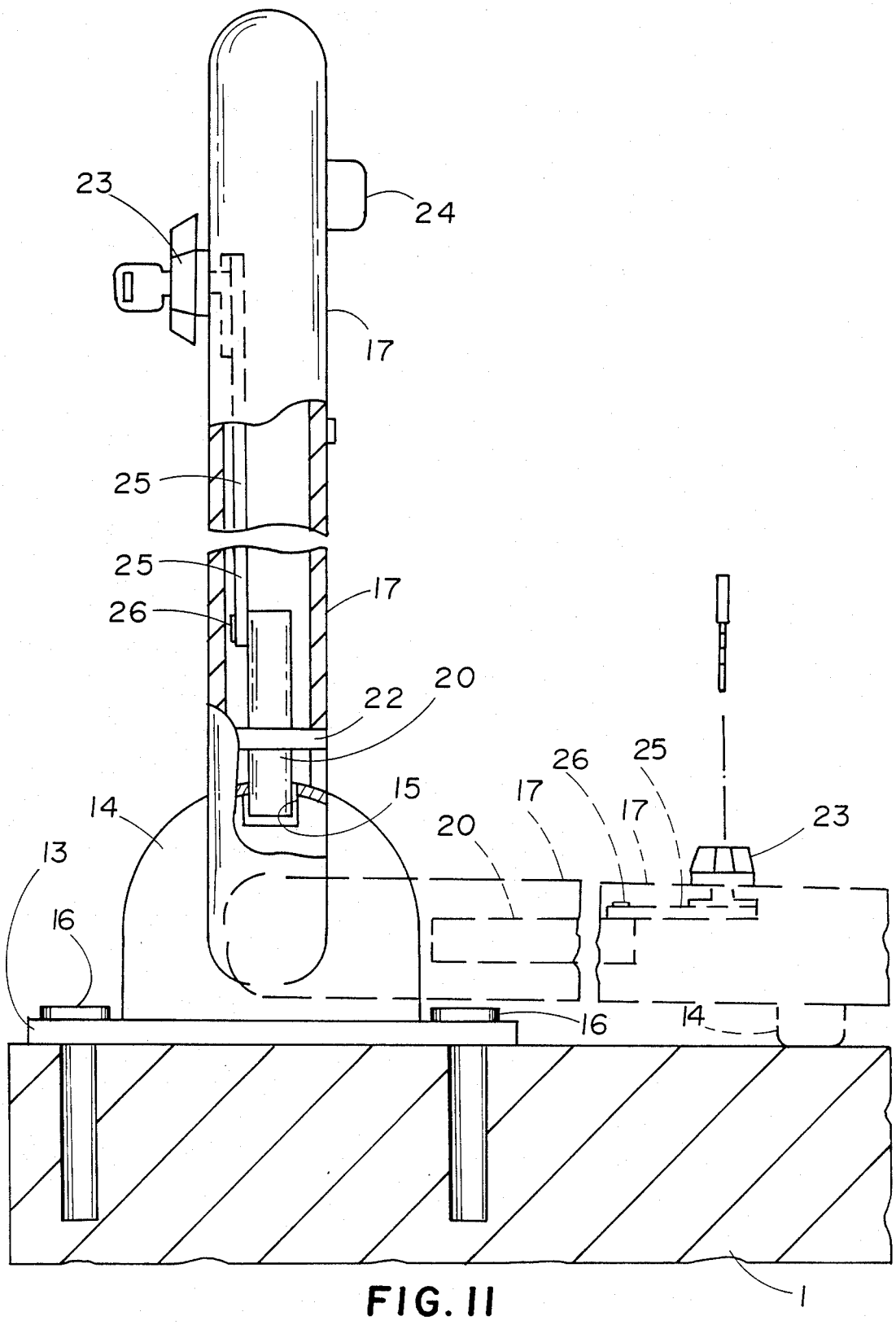

The frame 12 may then be pivoted (articulated) back into the first obstructing position (FIG. 11). The key (which if not still in the key lock 23) may first be inserted therein, is moved (or rotated) in a first (locking) direction. This movement permits the center bolt 20 to move longitudinally downwardly in the first lowering direction, whereby the bolt 20 is received in the aperture 15 and the member 14 and is moved into the first lowered position, supporting the frame 12.

The center bolt 20 may move downwardly in the first lowering direction either by fully moving in response to gravity, or its longitudinal movement may be precisely controlled in response to the movement of the key lock 23 (in the first direction). If desired, completion of this movement of the key lock 23 in the first direction may also lock and/or otherwise maintain the bolt 20 in the first lowered position, wherein it supports and holds the frame 12 in place.

The key may be removed from the key lock 23 as desired, so that unauthorized persons will not be able to lock or unlock the frame in order to gain unauthorized access to the parking space, roadway, passageway or the like.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A barrier for selectively restricting access to a parking space, roadway, passageway or the like, comprised of:

a heavy-duty base having an aperture formed therein;

a heavy-duty pivotal barrier frame journaled through the base below the aperture for pivotal movement of the barrier frame between a first obstructing position, wherein ingress and egress to the parking space, roadway, passageway or the like is prevented, and a second nonobstructing position, wherein ingress and egress to the parking space, roadway, passageway or the like is permitted;

a center bolt having a longitudinal axis, the center bolt being carried by the barrier frame for longitudinal movement of the center bolt between a first lowered position, wherein the center bolt is received through the aperture and into the base for securing and supporting the barrier frame in the first obstructing position and a second raised position, wherein the center bolt is spaced from the base for permitting the barrier frame to pivotally move between the first obstructing and second nonobstructing positions; and key lock means for withdrawing the bolt from the base, so that movement of the lock means in a first direction permits the bolt to move into the first lowered position when the frame is in the first obstructing position supporting the frame in the first obstructing position, and further so that movement of the lock means in a second direction moves the bolt into the second raised position permitting the frame to be selectively pivotally moved between the first obstructing and second nonobstructing positions.

2. A barrier for selectively restricting access to a parking space, roadway, passageway or the like, comprised of:

a base including an upwardly-extending member having an aperture formed therein;

a pivotal barrier frame journaled through the upwardly-extending member for pivotal movement of the barrier frame between a first obstructing position, wherein ingress and egress to the parking space, roadway, passageway or the like is prevented, and a second nonobstructing position, wherein ingress and egress to the parking space, roadway, passageway or the like is permitted;

a center bolt having a longitudinal axis, the center bolt being carried by the barrier frame with the longitudinal axis thereof intersecting the upwardly-extending member for longitudinal movement, of the center bolt between a first lowered position, wherein the center bolt is received through the aperture and in the upwardly-extending member for securing and supporting the barrier frame in the first obstructing position and a second raised position, wherein the center bolt is spaced from the upwardly-extending member for permitting the barrier frame to be pivotally moved between the first obstructing and second nonobstructing positions; and means for longitudinally withdrawing the bolt from the aperture and the upwardly-extending member and into the second raised position, so that the barrier frame can be pivoted between the first obstructing and second nonobstructing positions and for permitting the bolt to longitudinally move into the first lowered position when the frame is in the first obstructing position, so that the barrier frame is supported by the center bolt in the first obstructing position.

3. The barrier of claim 2, wherein the barrier frame is a heavy duty barrier frame, and further wherein the upwardly-extending member is an equally heavy duty member.

4. The barrier of claim 2, wherein the upwardly-extending member is substantially arcuate in shape.

5. The barrier of claim 2, wherein the means for longitudinally withdrawing the center bolt includes a key lock associated with the center bolt for locking the center bolt in at least its first lowered positions.

6. The barrier of claim 2, wherein the means for longitudinally withdrawing the center bolt includes a key lock associated with the center bolt, such that movement of the key lock in first and second opposite directions moves the center bolt in respectively the first lowering and second raising directions.

7. The barrier of claim 2, wherein the means for longitudinally withdrawing the center bolt includes a key lock associated with the center bolt, such that locking of the key lock moves the center bolt in the first lowering direction and into the first lowered portion wherein the center bolt is maintained, and further such that unlocking of the key lock moves the center bolt in the second raising direction and into the second raised position.

8. The barrier of claim 2, wherein the second nonobstructing position, the barrier frame is substantially parallel to the ground.

9. The barrier of claim 2, wherein the barrier frame includes at least one lower horizontal arm journaled through the upwardly-extending member along a horizontal pivot axis defined thereby for pivotal movement of the barrier frame about the pivot axis and the lower horizontal arm between the first obstructing and second nonobstructing positions.

10. The barrier of claim 9, wherein the aperture is formed in the upwardly-extending member above the pivot axis and the lower horizontal arm of the barrier frame.

11. The barrier of claim 9, further comprised of:

the barrier frame further including a substantially hollow housing portion; and the center bolt being position at least partially in the housing portion for the longitudinal movement of the center bolt in the housing portion between the first lowered and second raised positions.

12. The barrier of claim 9, wherein the barrier frame further includes a pair of spaced side arms being substantially parallel to the center bolt, each of said side arms including a respective lower portion, and wherein the lower horizontal arm is positioned between and integral with the respective lower portions of the side arms.

13. A barrier for selectively restricting access to a parking space, roadway, passageway or the like, comprised of:

a base including an upwardly-extending member having an aperture formed therein;

a pivotal barrier frame journaled through the upwardly-extending member for pivotal movement of the barrier frame between a first obstructing position, wherein ingress and egress to the parking space, roadway, passageway or the like is prevented, and a second nonobstructing position, wherein ingress and egress to the parking space, roadway, passageway or the like is permitted;

a center bolt having a longitudinal axis, the center bolt being carried by the barrier frame with the longitudinal axis thereof intersecting the upwardly-extending member for longitudinal movement of the center bolt between a first lowered position, wherein the center bolt is received through the aperture and in the upwardly-extending member for securing and supporting the barrier frame in the first obstructing position and a second raised position, wherein the center bolt is spaced from the upwardly-extending member for permitting the barrier frame to be pivotally moved between the first obstructing and second nonobstructing positions;

means for longitudinally withdrawing the bolt from the aperture and the upwardly-extending member into the second raised position, so that the barrier frame can be pivoted between the first obstructing and second nonobstructing positions and for permitting the bolt to longitudinally move into the first lowered position when the frame is in the first obstructing position, so that the barrier frame is supported by the center bolt in the first obstructing position;

wherein the barrier frame is a heavy duty barrier frame, and further wherein the upwardly-extending member is an equally heavy-duty member; and wherein the means for longitudinally withdrawing the center bolt includes a key lock associated with the center bolt, such that locking of the key lock moves the center bolt in the first lowering direction and into the first lowered position, and further such that unlocking of the key lock permits the center bolt to freely move in response to gravity in the first lowering direction and into the first lowered position.

14. A barrier for selectively restricting access to a parking space, roadway, passageway or the like, comprised of:

a base including an upwardly-extending member having an aperture formed therein;

a pivotal barrier frame journaled through the upwardly-extending member for pivotal movement of the barrier frame between a first obstructing position, wherein ingress and egress to the parking space, roadway, passageway or the like is prevented, and a second nonobstructing position, wherein ingress and egress to the parking space, roadway, passageway or the like is permitted;

a center bolt having a longitudinal axis, the center bolt being carried by the barrier frame with the longitudinal axis thereof intersecting the upwardly-extending member for longitudinal movement of the center bolt between a first lowered position, wherein the center bolt is received through the aperture and in the upwardly-extending member for securing and supporting the barrier frame in the first obstructing position and a second raised position, wherein the center bolt is spaced from the upwardly-extending member for permitting the barrier frame to be pivotally moved between the first obstructing and second nonobstructing positions, and means for longitudinally withdrawing the bolt from the aperture and the upwardly-extending member into the second raised position, so that the barrier frame can be pivoted between the first obstructing and second nonobstructing positions and for permitting the bolt to longitudinally move into the first lowered position when the frame is in the first obstructing position, so that the barrier frame is supported by the center bolt in the first obstructing position;

wherein the barrier frame includes at least one lower horizonal arm journaled through the upwardly-extending member along a horizontal pivot axis defined thereby for pivotal movement of the barrier frame about the pivot axis and the lower horizontal arm between the first obstructing and second nonobstructing positions;

the barrier frame further including a pair of spaced side arms being substantially parallel to the center bolt, each of said side arms including a respective lower portion, the lower horizontal arm positioned between and integral with the respective lower portions of the side arms and a substantially hollow housing portion positioned between the spaced side arms, the center bolt being positioned at least partially in the housing portion for the longitudinal movement of the center bolt therein between the first lowered and second raised positions.

15. A barrier for selectively restricting access to a parking space, roadway, passageway or the like, comprised of:

a base including a heavy-duty upwardly-extending member having an aperture formed therein;

a pivotal heavy-duty barrier frame journaled through the upwardly-extending member for pivotal movement of the barrier frame between a first obstructing position, wherein ingress and egress to the parking space, roadway, passageway or the like is prevented, and a second nonobstructing position, wherein ingress and egress to the parking space, roadway, passageway or the like is permitted;

a center bolt having a longitudinal axis, the center bolt being carried by the barrier frame with the longitudinal axis thereof intersecting the upwardly-extending member for longitudinal movement of the center bolt between a first lowered position, wherein the center bolt is received through the aperture and in the upwardly-extending member for securing and supporting the barrier frame in the first obstructing position and a second raised position, wherein the center bolt is spaced from the upwardly-extending member for permitting the barrier frame to be pivotally moved between the first obstructing and second nonobstructing positions; and means for longitudinally withdrawing the bolt from the aperture and the upwardly-extending member into the second raised position, so that the barrier frame can be pivoted between the first obstructing and second nonobstructing positions and for permitting the bolt to longitudinally move into the first lowered position when the frame is in the first obstructing position, so that the barrier frame is supported by the center bolt in the first obstructing position;

wherein the barrier frame includes at least one lower horizontal arm journaled through the upwardly-extending member along a horizontal pivot axis defined thereby for pivotal movement of the barrier frame about the pivot axis and the lower horizontal arm between the first obstructing and second nonobstructing positions;

the barrier frame further including a pair of spaced side arms being substantially parallel to the center bolt, each of said side arms including a respective lower portion, the lower horizontal arm positioned between and integral with the respective lower portions of the side arms and a substantially hollow housing portion positioned between the spaced side arms, the center bolt being positioned at least partially in the housing portion for the longitudinal movement of the center bolt therein between the first lowered and second raised positions.

16. A barrier for selectively restricting access to a parking space, roadway, passageway or the like, comprised of:

a base including a heavy-duty upwardly-extending member having an aperture formed therein;

a pivotal heavy-duty barrier frame journaled through the upwardly-extending member for pivotal movement of the barrier frame between a first obstructing position, wherein ingress and egress to the parking space, roadway, passageway or the like is prevented, and a second nonobstructing position, wherein ingress and egress to the parking space, roadway, passageway or the like is permitted;

a center bolt having a longitudinal axis, the center bolt being carried by the barrier frame with the longitudinal axis thereof intersecting the upwardly-extending member for longitudinal movement of the center bolt between a first lowered position, wherein the center bolt is received through the aperture and in the upwardly-extending member for securing and supporting the barrier frame in the first obstructing position and a second raised position, wherein the center bolt is spaced from the upwardly-extending member for permitting the barrier frame to be pivotally moved between the first obstructing and second nonobstructing positions; and means for longitudinally withdrawing the bolt from the aperture and the upwardly-extending member into the second raised position, so that the barrier frame can be pivoted between the first obstructing and second nonobstructing positions and for permitting the bolt to longitudinally move into the first lowered position when the frame is in the first obstructing position, so that the barrier frame is supported by the center bolt in the first obstructing position;

the barrier frame further including a substantially hollow housing portion; and the center bolt being positioned at least partially in the housing portion for the longitudinal movement of the center bolt in the housing portion between the first lowered and second raised positions.

17. A barrier for selectively restricting access to a parking space, roadway, passageway or the like, comprised of:

a base including a heavy-duty upwardly-extending member having an aperture formed therein;

a pivotal heavy-duty barrier frame journaled through the upwardly-extending member for pivotal movement of the barrier frame between a first obstructing position, wherein ingress and egress to the parking space, roadway, passageway or the like is prevented, and a second nonobstructing position, wherein ingress and egress to the parking space, roadway, passageway or the like is permitted;

a center bolt having a longitudinal axis, the center bolt being carried by the barrier frame with the longitudinal axis thereof intersecting the upwardly-extending member for longitudinal movement of the center bolt between a first lowered position, wherein the center bolt is received through the aperture and in the upwardly-extending member for securing and supporting the barrier frame in the first, obstructing position and a second raised position, wherein the center bolt is spaced from the upwardly-extending member for permitting the barrier frame to be pivotally moved between the first obstructing and second nonobstructing positions; and means for longitudinally withdrawing the bolt from the aperture and the upwardly-extending member into the second raised position, so that the barrier frame can be pivoted between the first obstructing and second nonobstructing positions and for permitting the bolt to longitudinally move into the first lowered position when the frame is in the first obstructing position, so that the barrier frame is supported by the center bolt in the first obstructing position;

wherein the means for longitudinally withdrawing the center bolt includes a key lock associated with the center bolt, such that turning of the key lock in a first direction permits the center bolt to move in the first lowering direction and into the first lowered position and further such that turning of the key lock in a second opposite direction moves the center bolt in the second raising direction withdrawing the center bolt from the aperture and into the second raised position;

the barrier frame further including a substantially hollow housing portion; and the center bolt being positioned at least partially in the housing portion for the longitudinal movement of the center bolt in the housing portion between the first lowered and second raised positions.

18. A barrier for selectively restricting access to a parking space, roadway, passageway or the like, comprised of:

a base including an upwardly-extending member having an aperture formed therein;

a pivotal barrier frame journaled through the upwardly-extending member for pivotal movement of the barrier frame between a first obstructing position, wherein ingress and egress to the parking space, roadway, passageway or the like is prevented, and a second nonobstructing position, wherein ingress and egress to the parking space, roadway, passageway or the like is permitted;

a center bolt having a longitudinal axis, the center bolt being carried by the barrier frame with the longitudinal axis thereof intersecting the upwardly-extending member for longitudinal movement of the center bolt between a first lowered position, wherein the center bolt is received through the aperture and in the upwardly-extending member for securing and supporting the barrier frame in the first obstructing position and a second raised position, wherein the center bolt is spaced from the upwardly-extending member for permitting the barrier frame to be pivotally moved between the first obstructing and second nonobstructing positions; and means for longitudinally withdrawing the bolt from the aperture and the upwardly-extending member into the second raised position, so that the barrier frame can be pivoted between the first obstructing and second nonobstructing positions and for permitting the bolt to longitudinally move into the first lowered position when the frame is in the first obstructing position, so that the barrier frame is supported by the center bolt in the first obstructing position; and wherein the means for longitudinally withdrawing the center bolt includes a key lock associated with the center bolt, such that turning of the key lock in a first direction permits the center bolt to move in the first lowering direction and into the first lowered position and further such that turning of the key lock in a second opposite direction moves the center bolt in the second raising direction withdrawing the center bolt from the aperture and into the second raised position; and wherein the key lock is associated with the center bolt for locking the center bolt in at least the first lowered position.

19. A barrier for selectively restricting access to a parking space, roadway, passageway or the like, comprised of:

a base including a heavy-duty upwardly-extending member having an aperture formed therein;

a pivotal heavy-duty barrier frame journaled through the upwardly-extending member for pivotal movement of the barrier frame between a first obstructing position; wherein ingress and egress to the parking space, roadway, passageway or the like is prevented, and a second nonobstructing position, wherein ingress and egress to the parking space, roadway, passageway or the like is permitted;

a center bolt having a longitudinal axis, the center bolt being carried by the barrier frame with the longitudinal axis thereof intersecting the upwardly-extending member for longitudinal movement of the center bolt between a first lowered position, wherein the center bolt is received through the aperture and in the upwardly-extending member for securing and supporting the barrier frame in the first obstructing position and a second raised position, wherein the center bolt is spaced from the upwardly-extending member for permitting the barrier frame to be pivotally moved between the first obstructing and second nonobstructing positions; and means for longitudinally withdrawing the bolt from the aperture and the upwardly-extending member into the second raised position, so that the barrier frame can be pivoted between the first obstructing and second nonobstructing positions and for permitting the bolt to longitudinally move into the first lowered position when the frame is in the first obstructing position, so that the barrier frame is supported by the center bolt in the first obstructing position;

wherein the means for longitudinally withdrawing the center bolt includes a key lock associated with the center bolt, such that turning of the key lock in a first direction permits the center bolt to move in the first lowering direction and into the first lowered position and further such that turning of the key lock in a second opposite direction moves the center bolt in the second raising direction withdrawing the center bolt from the aperture and into the second raised position;

wherein the barrier frame includes at least one lower horizontal arm journaled through the upwardly-extending member along a horizontal pivot axis defined thereby for pivotal movement of the barrier frame about the pivot axis and the lower horizontal arm between the first obstructing and second nonobstructing positions;

the barrier frame further including a substantially hollow housing portion; and the center bolt being positioned at least partially in the housing portion for the longitudinal movement of the center bolt in the housing portion between the first lowered and second raised positions.

20. A barrier for selectively restricting access to a parking space, roadway, passageway or the like, comprised of:

a base including an upwardly-extending member having an aperture formed therein;

a pivotal barrier frame journaled through the upwardly-extending member for pivotal movement of the barrier frame between a first obstructing position, wherein ingress and egress to the parking space, roadway, passageway or the like is prevented and a second nonobstructing position, wherein ingress and egress to the parking space, roadway, passageway or the like is permitted, said barrier frame including a housing portion;

a center bolt having a longitudinal axis, the center bolt being positioned at least partially in the housing portion with the longitudinal axis of the center bolt intersecting the upwardly-extending bolt in the housing portion between a first lowered position, wherein the center bolt is received through the aperture and in the upwardly-extending member for securing and supporting the barrier frame in the first obstructing position and a second raised position, wherein the center bolt is spaced from the upwardly-extending member for permitting the barrier frame to be pivotally moved between the first obstructing and second nonobstructing positions; and means for longitudinally withdrawing the bolt from the aperture and the upwardly-extending member and into the second raised position, so that the barrier frame can be pivoted between the first obstructing and second nonobstructing positions and for permitting the bolt to longitudinally move into the first lowered position when the frame is in the first obstructing position, so that the barrier frame is supported by the center bolt in the first obstructing position.

* * * * *